US005188177A

United States Patent [19]

Curry

[11] Patent Number: 5,188,177

[45] Date of Patent: Feb. 23, 1993

[54] MAGNETIC-PULSE SEALING OF OIL-WELL-HEAD PIPE

[75] Inventor: Randy D. Curry, Pleasanton, Calif.

[73] Assignee: The Titan Corporation, San Diego, Calif.

[21] Appl. No.: 730,668

[22] Filed: Jul. 16, 1991

[51] Int. Cl.[5] ..... E21B 33/02

[52] U.S. Cl. ..... 166/297; 166/55; 166/66.5; 166/75.1; 166/379

[58] Field of Search ..... 166/285, 286, 297, 376, 166/379, 380, 381, 55, 66.5, 75.1

[56] References Cited

U.S. PATENT DOCUMENTS

| | | | |
|---|---|---|---|
| Re. 29,016 | 10/1976 | Peacock | 219/9.5 |
| 3,541,823 | 11/1970 | Weadock, Jr. | 72/56 |
| 3,599,461 | 8/1971 | Astl | 72/56 |
| 3,599,462 | 8/1971 | Kline et al. | 72/56 |
| 3,621,175 | 11/1971 | Prevett | 219/9.5 |
| 3,654,787 | 4/1972 | Brower | 72/56 |
| 3,739,845 | 6/1973 | Berry et al. | 166/65.1 |
| 3,888,098 | 6/1975 | Larrimer, Jr. et al. | 72/56 |
| 3,975,936 | 8/1976 | Baldwin et al. | 72/38 |
| 4,061,967 | 12/1977 | Hall | 166/66.5 X |
| 4,531,393 | 7/1985 | Weir | 72/56 |
| 4,542,267 | 9/1985 | Christensen et al. | 219/9.5 |
| 4,610,069 | 9/1986 | Darbois . | |
| 4,619,127 | 10/1986 | Sano et al. | 72/56 |
| 4,628,294 | 12/1986 | Parker et al. | 337/248 |
| 4,715,442 | 12/1987 | Kahil et al. | 166/66.5 X |
| 4,716,960 | 1/1988 | Eastlund et al. | 166/65.1 X |
| 4,791,373 | 12/1988 | Kuckles | 166/66.5 X |
| 4,962,656 | 10/1990 | Kunerth et al. | 72/56 |

FOREIGN PATENT DOCUMENTS

| | | | |
|---|---|---|---|
| 541970 | 3/1977 | U.S.S.R. | 166/66.5 |
| 1439207 | 11/1988 | U.S.S.R. | 166/66.5 |

OTHER PUBLICATIONS

Brown et al., "Pulse Magnetic Welding of Breeder Reactor Fuel Pin End Closures", Welding Journal, Jun. 1978, pp. 22–56.

Bennett et al., "Electromagnetic Forming–An Industrial Application of Pulsed Power", Texas Tech University, pp. 6–19.

*Primary Examiner*—George A. Suchfield

*Attorney, Agent, or Firm*—Edward W. Callan

[57] ABSTRACT

A well-head pipe of a leaking oil well is sealed by radial application of a high-energy magnetic pulse to the well-head pipe to thereby plastically deform the metal of the pipe casing and form the metal into a seal that caps the well-head pipe without cracking the pipe. A system for sealing an oil-well-head pipe having a metal casing includes an electromagnet dimensioned for placement around an exposed portion of the well-head pipe, with the electromagnet being disposed to radially apply a magnetic field to the pipe when the electromagnet is placed around the exposed portion of the pipe; and a capacitor bank and a transmission line for providing a high-energy current pulse to the electromagnet to cause the electromagnet to radially apply a high-energy magnetic pulse to the pipe to plastically deform the metal of the pipe casing and form the metal into a seal that caps the well-head pipe.

10 Claims, 1 Drawing Sheet

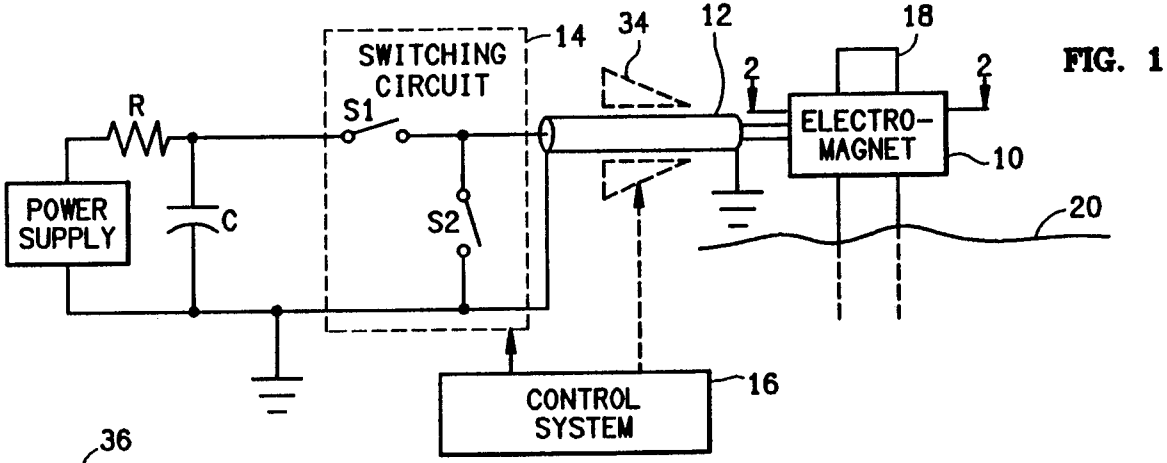
FIG. 1
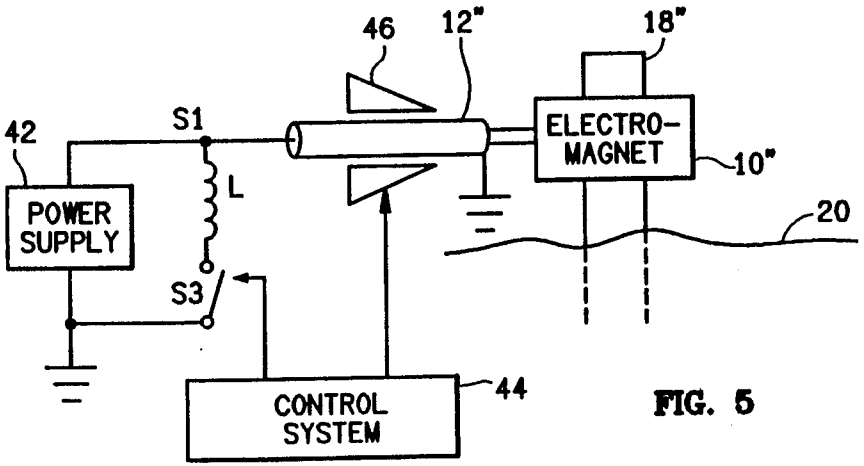
FIG. 5
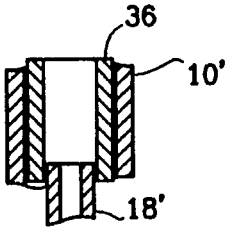
FIG. 4A
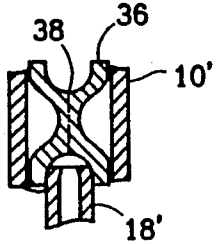
FIG. 4B
FIG. 2
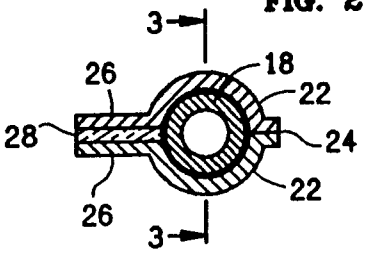
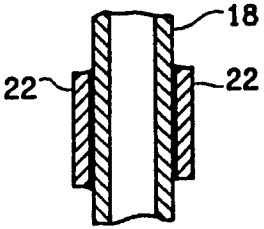
FIG. 3A
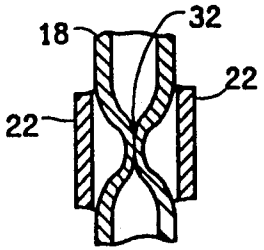
FIG. 3B

MAGNETIC-PULSE SEALING OF OIL-WELL-HEAD PIPE

BACKGROUND OF THE INVENTION

The present invention generally pertains to the sealing of oil-well-head pipes and is particularly directed to a method and system for sealing oil-well-head pipes that can be utilized for capping leaking oil wells.

In the prior art, one technique for capping a leaking oil well after a fire, if any, has been extinguished is to lower a weighted cap onto the well-head pipe. If this technique is not utilized, an alternative technique for capping the well is to mechanically crimp the well-head pipe. Mechanical crimping of the pipe is not widely used, however, since mechanical crimping may crack the metal casing of the pipe. Another technique for capping a leaking oil well, which is used when the well is on fire, is the use of explosives. When a leaking oil well is on fire, the fire typically is extinguished by using explosives, and the shock wave produced by the explosives sometimes crimps the pipe shut. However, the explosive shock wave sometimes also leaves cracks in the pipe.

SUMMARY OF THE INVENTION

In accordance with the present invention, the well-head pipe of a leaking oil well is sealed by radial application of a high-energy magnetic pulse to the well-head pipe to thereby plastically deform the metal of the pipe casing to form the metal into a seal that caps the well-head pipe without cracking the pipe.

The technology of reshaping a metal object by applying a high-energy magnetic pulse to the metal object to thereby plastically deform the metal into a desired configuration is known as electromagnetic forming and is described in U.S. Pat. Nos. 3,541,823; 3,599,461; 3,599,462; Re.29,016; 3,621,175; 3,654,787; 3,888,098; 3,975,936; 4,531,393; 4,542,267; 4,610,069; 4,619,127; 4,628,294; and 4,962,656.

The present invention provides a method of sealing an oil-well-head pipe having a metal casing, comprising the steps of (a) placing an electromagnet around an exposed portion of the well-head pipe, with the electromagnet being disposed to radially apply a magnetic field to the pipe; and (b) radially applying a high-energy magnetic pulse to the pipe with the electromagnet to plastically deform the metal of the pipe casing to form the metal into a seal that caps the well-head pipe.

The present invention also provides a system for sealing an oil-well-head pipe having a metal casing, comprising an electromagnet dimensioned for placement around an exposed portion of the well-head pipe, with the electromagnet being disposed to radially apply a magnetic field to the pipe when the electromagnet is placed around the exposed portion of the pipe; and means for providing a high-energy current pulse to the electromagnet to cause the electromagnet to radially apply a high-energy magnetic pulse to the pipe to plastically deform the metal of the pipe casing to form the metal into a seal that caps the well-head pipe.

By using an electromagnet to radially apply a magnetic field to the well-head pipe the plastic deformation of the metal of the pipe casing can be controlled and tailored explicitly to the wall thickness of the metal casing, to thereby assure that the pipe will be sealed and remove the uncertainty associated with the prior art oil-well-head sealing techniques.

Additional features of the present invention are described in relation to the description of the preferred embodiments.

BRIEF DESCRIPTION OF THE DRAWING

FIG. 1 is a diagram of a preferred embodiment of a system according to the present invention.

FIG. 2 is a horizontal sectional view taken along line 2—2 of FIG. 1 showing the electromagnet positioned around the well-head pipe.

FIG. 3A is a vertical sectional view taken along line 3—3 of FIG. 2 showing the electromagnet positioned around the well-head pipe prior to application of a magnetic field to the metal casing of the pipe.

FIG. 3B is a vertical sectional view taken along line 3—3 of FIG. 2 showing the electromagnet in position around the well-head pipe after the well-head pipe has been sealed.

FIG. 4A is a vertical sectional view showing an electromagnet positioned around a metal liner and the well-head pipe in an alternative embodiment of the present invention prior to application of a magnetic field to the liner.

FIG. 4B is a vertical sectional view showing the electromagnet of FIG. 4A in position around the liner and the well-head pipe after the well-head pipe has been sealed.

FIG. 5 is a diagram of another preferred embodiment of a system according to the present invention.

DESCRIPTION OF THE PREFERRED EMBODIMENTS

Referring to FIG. 1, one preferred embodiment of a system according to the present invention includes an electromagnet 10, a transmission line 12, a switching circuit 14, a bank of capacitors C and a control system 16.

The electromagnet 10 is placed around an exposed portion of an oil-well-head pipe 18 having a metal casing, which extends beneath the ground surface 20. Typically the metal casing of oil-well pipe 18 includes a ferrous metal, such as steel. The electromagnet 10 includes two stainless steel components 22 having semi-cylindrical portions that are bolted together at 24 to form a single-turn winding around the exposed portion of the pipe 18. The winding is disposed as shown in FIGS. 2, 3A and 3B to radially apply a magnetic field to the pipe 18. Each of the two components 22 includes a terminal portion 26 that extends from the semi-cylindrical portion for connection to the transmission line 12. The extended terminal portions 26 of the separate components 22 are separated by a layer of insulation 28.

Energy is stored in the capacitor bank C from an electrical power supply 30 via a resistance R. The capacitor bank C is coupled to the electromagnet 10 by the switching circuit 14 and the transmission line 12.

The switching circuit includes a first switch S1 connected in series between the capacitor bank C and the transmission line 12 for enabling the stored energy to be transmitted to the electromagnet 10 when the switch S1 is closed. The operation of the switching circuit 14 is controlled by the control system 16.

After energy in the megajoule range has been stored in the capacitor bank C, the first switch S1 is closed and the stored high-energy charge is transmitted via the transmission line 12 to the electromagnet 10 as a high-energy current pulse in the mega-amp range, whereupon the electromagnet 10 radially applies a high-energy magnetic pulse to the pipe 18 to thereby plastically deform the metal of the pipe casing 18 and form the metal into a seal 32 that caps the well-head pipe 18, as shown in FIG. 3B.

The switching circuit 14 also includes a second switch S2, which is closed by the control system 16 as soon as the high-energy charge reaches the electromagnet 10 in order to short circuit the transmission line 12 between the capacitor bank C and the electromagnet 10 and thereby prevent return to the capacitor bank C of any of the energy transmitted from the capacitor bank C to the electromagnet 10.

The deformed metal then creates a permanent seal 32 capping the well-head-pipe 18.

When it is desired to reopen the pipe 18, the pipe can be tapped by a hot-tapping technique known to those skilled in such art.

In an alternative embodiment, in which the switching circuit 14 does not include the second switch S2, a shaped plastic explosive charge 34 wrapped around the transmission line 12 (as shown by dashed lines in FIG. 1) is detonated by the control system 16 as soon as the high-energy current pulse reaches the electromagnet 10 to time-compress the current pulse and the resultant magnetic pulse and thereby increase the amplitude of the magnetic pulse. Detonation of the explosive 34 also breaks the connection provided by the transmission line 12 between the capacitor bank C and the electromagnet 10 and thereby prevents return to the capacitor bank C of any of the energy transmitted from the capacitor bank C to the electromagnet 10.

In another alternative embodiment, as shown in FIGS. 4A and 4B, a metal liner 36 is placed around and overlaps an open end of the well-head pipe 18'; and an electromagnet 10' dimensioned for placement around the metal liner 36 is disposed to radially apply a magnetic field to the metal liner 36. In other respects, the system of this alternative embodiment is the same as the system described above with reference to FIG. 1.

When a high energy pulse is delivered to the electromagnet 10', the electromagnet 10' radially applies a high-energy magnetic pulse to the metal liner 36 to plastically deform the metal of the liner 36 and form the metal into a seal 38 that becomes welded to and caps the well-head pipe 18'.

In other preferred embodiments, the capacitor bank C is replaced by other means for high-energy storage, such as an inductance coil, as shown in FIG. 5, or by means for storing mechanical energy such as a homopolar generator, (not shown), which is coupled to a switching circuit and a transmission line.

Referring to FIG. 5, an embodiment utilizing an inductance coil L also includes a switch S3, a power supply 42, a control system 44 and a shaped plastic explosive charge 46. The inductance coil L and the switch S3 are connected in series across the power source 42. The inductance coil L is also connected to a transmission line 12''. The transmission line 12'' is connected to an electromagnet 10'', which is placed around an exposed portion of a well-head-pipe 18'', as in the embodiment described above with reference to FIG. 1. The control system 44 controls operation of the switch S3 and detonation of the plastic explosive charge 46. The plastic explosive charge 46 is shaped and wrapped around the transmission line 12''.

Initially the switch S3 is in a closed position as energy from the power source 42 is stored in the inductance coil L. After a high-energy discharge in the megajoule range has been stored in the inductance coil L, the switch S3 is opened and the stored high-energy is transmitted via the transmission line 12'' to the electromagnet 10'' as a high-energy current pulse in the maga-amp range, whereupon the electromagnet 10'' radially applies a high-energy magnetic pulse to the pipe 18'' to thereby plastically deform the metal of the pipe casing 18'' to form the metal into a seal that caps the well-head pipe 18''.

The shaped plastic explosive charge 46 is detonated by the control system 44 as soon as the high-energy current pulse reaches the electromagnet 10'' to time-compress the current pulse and the resultant magnetic pulse and thereby increase the amplitude of the magnetic pulse. Detonation of the explosive 46 also breaks the connection provided by the transmission line 12'' between the inductance coil L and the electromagnet 10'' and thereby prevents return to the inductance coil L of any of the energy transmitted from the coil L to the electromagnet 10''.

In still another embodiment (not shown) a power source is coupled directly to an electromagnet placed around an exposed portion of a well-head pipe via a transmission line and a plastic explosive charge is shaped and wrapped around the transmission line to function as a flux compressor as in the embodiments described above with reference to FIGS. 1 and 5.

I claim:

1. A method of sealing an oil-well-head pipe having a metal casing, comprising the steps of (a) placing an electromagnet around an exposed portion of the well-head pipe, with the electromagnet being disposed to radially apply a magnetic field to the pipe; and (b) radially applying a high-energy magnetic pulse to the pipe with the electromagnet to plastically deform the metal of the pipe casing to form the metal into a seal that caps the well-head pipe.

2. A method according to claim 1, further comprising the step of (c) time-compressing the magnetic pulse to thereby increase the amplitude of the pulse.

3. A system for sealing an oil-well-head pipe having a metal casing, comprising an electromagnet dimensioned for placement around an exposed portion of the well-head pipe, with the electromagnet being disposed to radially apply a magnetic field to the pipe when the electromagnet is placed around the exposed portion of the pipe; and means for providing a high-energy current pulse to the electromagnet to cause the electromagnet to radially apply a high-energy magnetic pulse to the pipe to plastically deform the metal of the pipe casing and form the metal into a seal that caps the well-head pipe.

4. A system according to claim 3, further comprising means for time-compressing the magnetic pulse to thereby increase the amplitude of the magnetic pulse.

5. A system according to claim 4, wherein the system includes a transmission line for transmitting the high-energy current pulse to the electromagnet; and wherein the means for time-compressing the magnetic pulse includes an explosive charge disposed on the transmission line and shaped for time-compressing the the current pulse to thereby time compress and increase the amplitude of the magnetic pulse.

6. A method of sealing an oil-well-head pipe, comprising the steps of (a) placing a metal liner around and overlapping an open end the well-head pipe;

(b) placing an electromagnet around the metal liner with the electromagnet being disposed to radially apply a magnetic field to the metal liner; and (c) radially applying a high-energy magnetic pulse to the metal liner with the electromagnet to plastically deform the metal of the liner to form the metal into a seal that caps the well-head pipe.

7. A method according to claim 6, further comprising the step of (d) time-compressing the magnetic pulse to thereby increase the amplitude of the pulse.

8. A system for sealing an oil-well-head pipe, comprising a metal liner for placement around and overlapping an open end of the well-head pipe;

an electromagnet dimensioned for placement around the metal liner, with the electromagnet being disposed to radially apply a magnetic field to the metal liner when the electromagnet is placed around the metal liner; and means for providing a high-energy current pulse to the electromagnet to cause the electromagnet to radially apply a high-energy magnetic pulse to the metal liner to plastically deform the metal of the liner to form the metal into a seal that caps the well-head pipe.

9. A system according to claim 8, further comprising means for time-compressing the magnetic pulse to thereby increase the amplitude of the magnetic pulse.

10. A system according to claim 9, wherein the system includes a transmission line for transmitting the high-energy current pulse to the electromagnet; and wherein the means for time-compressing the magnetic pulse includes an explosive charge disposed on the transmission line and shaped for time-compressing the current pulse to thereby time compress and increase the amplitude of the magnetic pulse.

* * * * *